US006959513B1

(12) United States Patent
Ruscito, Sr.

(10) Patent No.: US 6,959,513 B1
(45) Date of Patent: Nov. 1, 2005

(54) DECK COVERING APPARATUS

(76) Inventor: Raymond A. Ruscito, Sr., 2 Dreamland St., Manor Village, NY (US) 11950

( * ) Notice: Subject to any disclaimer, the term of this patent is extended or adjusted under 35 U.S.C. 154(b) by 0 days.

(21) Appl. No.: 10/609,427

(22) Filed: Jun. 27, 2003

(51) Int. Cl.[7] ..... E04B 1/346; E04B 7/16
(52) U.S. Cl. ..... 52/64; 52/66; 52/68; 52/650.3
(58) Field of Search ..... 52/74, 66, 68, 52/69, 67, 6, 64, 650.3; 160/201, 236; 4/498, 4/503

(56) References Cited

U.S. PATENT DOCUMENTS 4,073,098 A 2/1978 Baker
4,301,851 A 11/1981 Gitkin
4,616,451 A 10/1986 Glick
5,063,730 A 11/1991 Muramoto et al.
5,167,341 A 12/1992 Morton et al.
5,732,756 A * 3/1998 Malott ..... 160/67
D403,083 S 12/1998 Poelvoorde et al.
5,848,630 A * 12/1998 Manzo ..... 160/113
6,053,235 A * 4/2000 Ruffner, Sr. ..... 160/89
6,374,433 B1 * 4/2002 Gray ..... 4/498
6,540,003 B1 * 4/2003 Martin ..... 160/201
6,629,387 B2 * 10/2003 Whitley et al. ..... 52/64

* cited by examiner

*Primary Examiner*—Carl D. Friedman
*Assistant Examiner*—Chi Q. Nguyen

(57) ABSTRACT

A deck covering apparatus for selectively covering a portion of a deck from the elements. The deck covering apparatus includes a pair of support assemblies each having a base portion and a rail member. The base portion is designed for coupling to a support structure. The rail member is coupled to the base portion whereby the base portion of each of the support assemblies is designed for supporting the rail member of an associated one of the support assemblies in a spaced relationship above the deck. Each of a plurality of panel assemblies is slidably coupled to the rail member of each of the support assemblies. Each of the panel assemblies is slidably positionable along a length of the rail member of each of the support assemblies whereby each of the panel assemblies are designed for covering a portion of the deck from the elements.

16 Claims, 4 Drawing Sheets

DECK COVERING APPARATUS

BACKGROUND OF THE INVENTION

1. Field of the Invention

The present invention relates to movable shutters and awnings and more particularly pertains to a new deck covering apparatus for selectively covering a portion of a deck from the elements.

2. Description of the Prior Art

The use of movable shutters and awnings is known in the prior art. U.S. Pat. No. 4,301,851 describes a system for having an awning the move to form a shutter over a door. Another type of movable shutters and awnings is U.S. Pat. No. 4,616,451 having a plurality of roofing units positioned in a overlapping arrangement for extending outwardly from a building to cover a porch or deck.

SUMMARY OF THE INVENTION

Still yet another object of the present invention is to provide a new deck covering apparatus that allows a user to selectively cover a portion of a deck.

Even still another object of the present invention is to provide a new deck covering apparatus that permits separate sections of a deck to covered at the same time.

To this end, the present invention generally comprises a pair of support assemblies each having a base portion and a rail member. The base portion is designed for coupling to a support structure. The rail member is coupled to the base portion whereby the base portion of each of the support assemblies is designed for supporting the rail member of an associated one of the support assemblies in a spaced relationship above the deck. Each of a plurality of panel assemblies is slidably coupled to the rail member of each of the support assemblies whereby each of the panel assemblies is positioned between the support assemblies. Each of the panel assemblies is slidably positionable along a length of the rail member of each of the support assemblies whereby each of the panel assemblies are designed for covering a portion of the deck from the elements.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
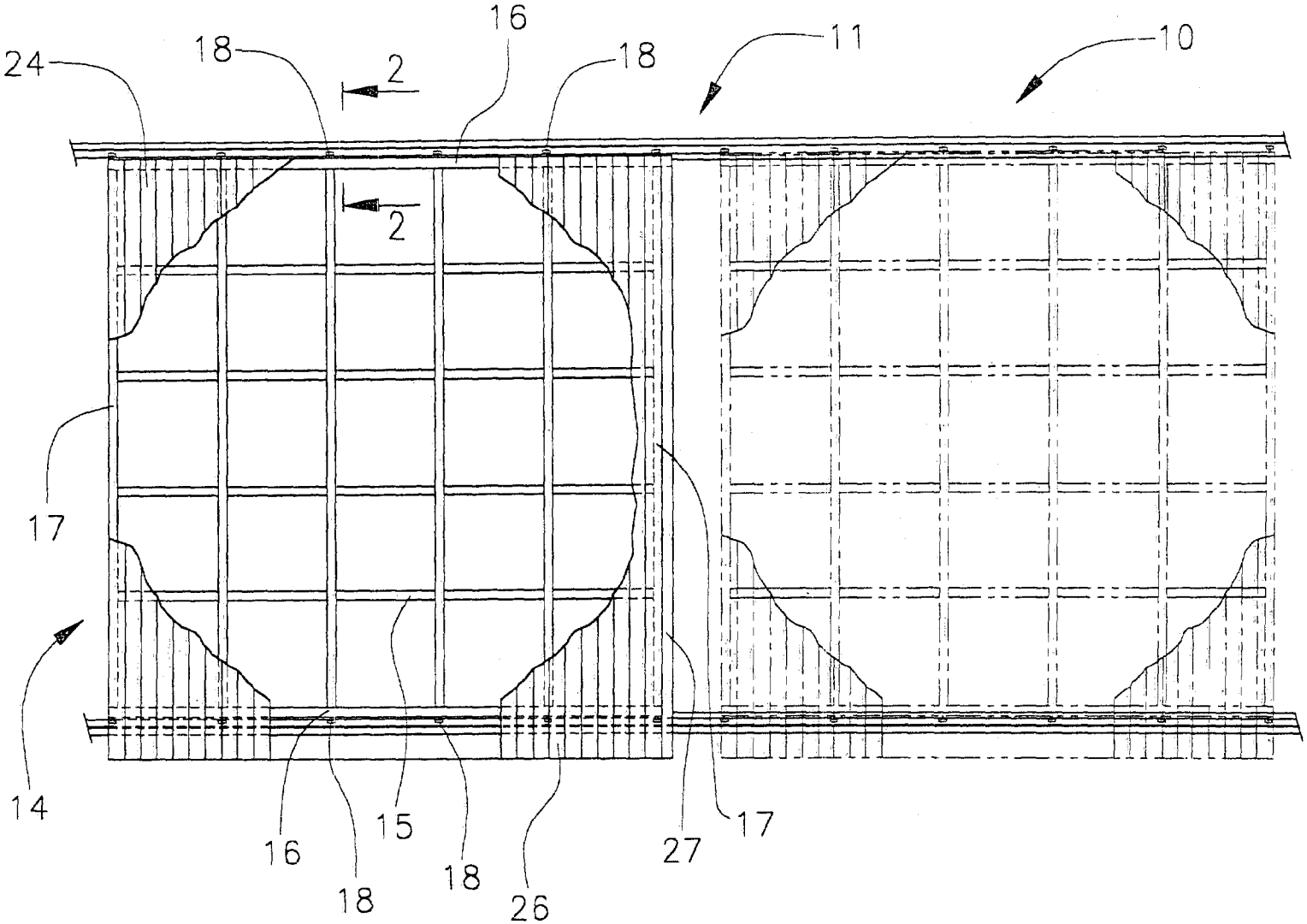
FIG. 1 is a top view of a new deck covering apparatus according to the present invention showing a single panel assembly.
Figure 2:
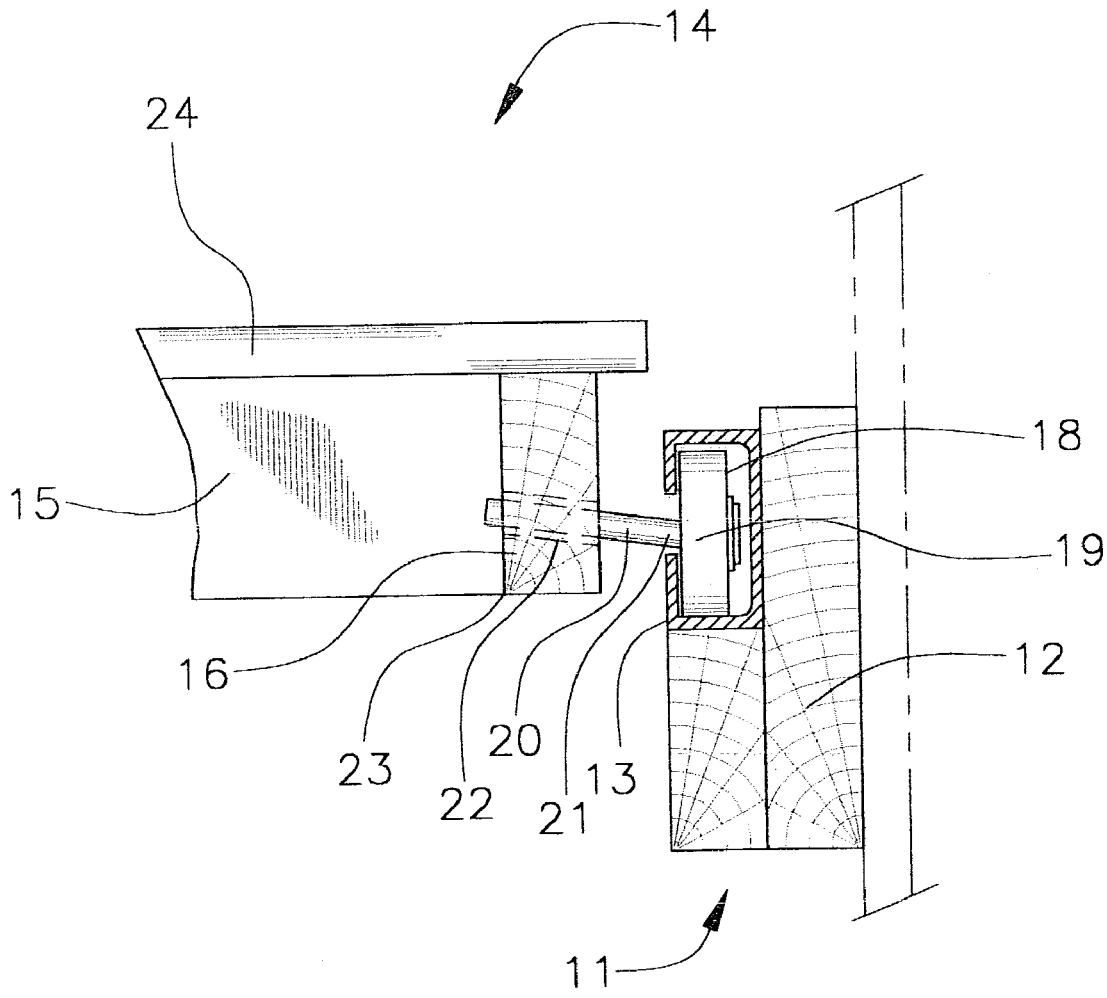
FIG. 2 is a cross-sectional view of the present invention taken along line 2—2 of FIG. 1.
Figure 3:
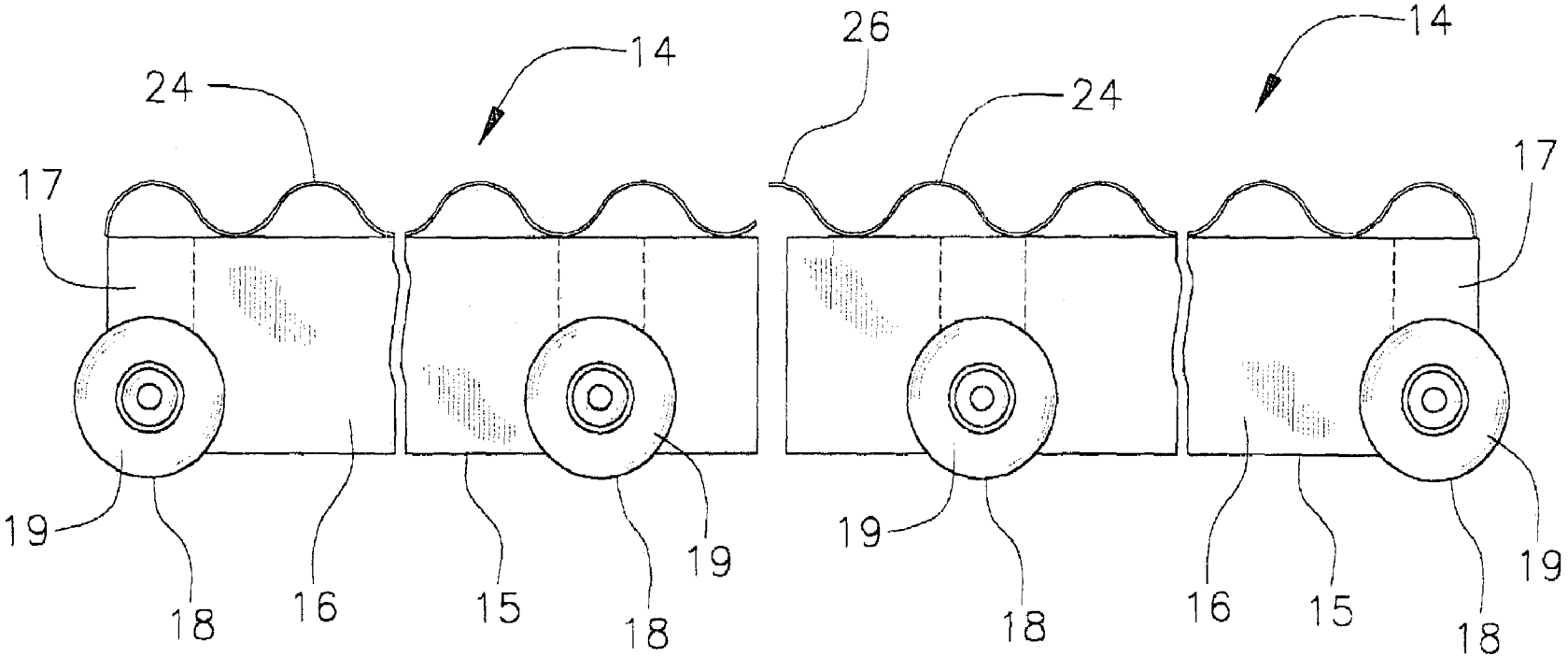
FIG. 3 is a side view of a pair of panel assemblies of the present invention.
Figure 4:
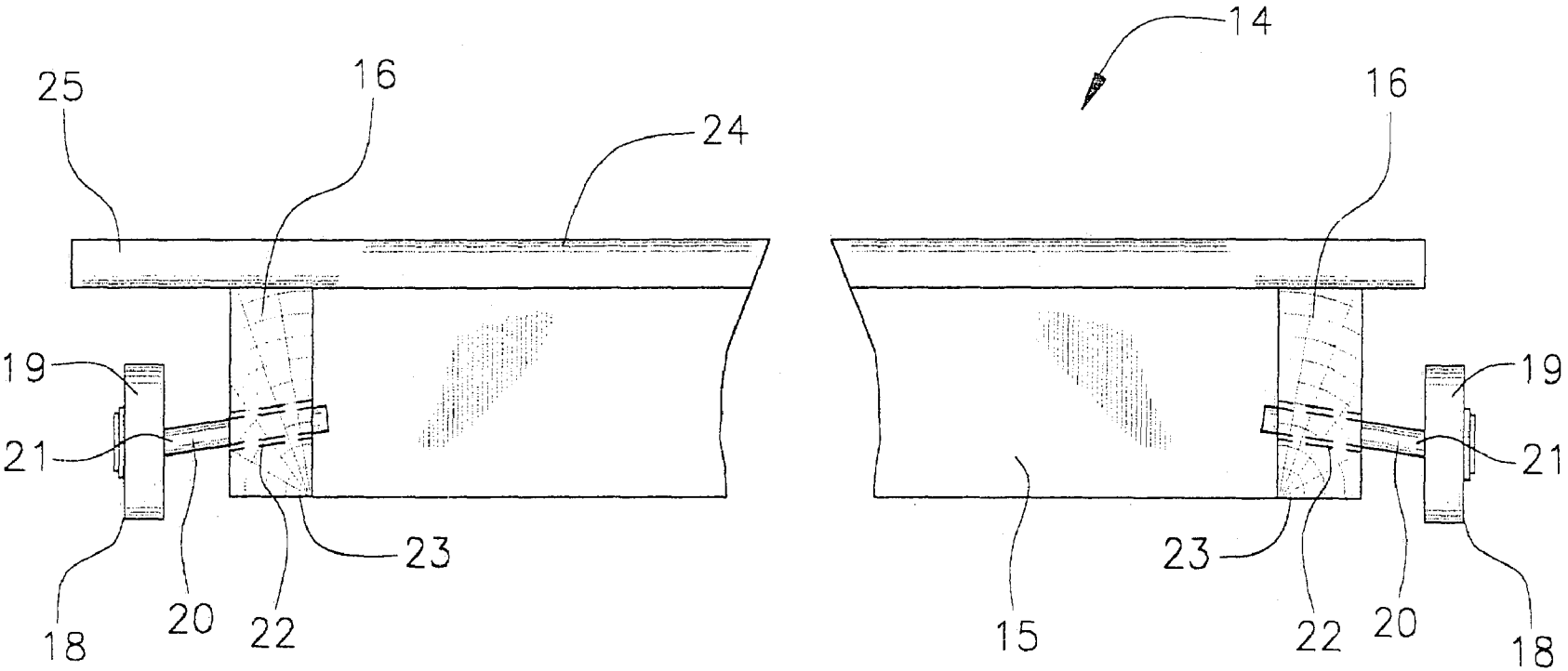
FIG. 4 is a cross-sectional view of one of the panel assemblies of the present invention.

With reference now to the drawings, and in particular to FIGS. 1 through 4 thereof, a new deck covering apparatus embodying the principles and concepts of the present invention and generally designated by the reference numeral 10 will be described.

As best illustrated in FIGS. 1 through 4, the deck covering apparatus 10 generally comprises a pair of support assemblies 11 each having a base portion 12 and a rail member 13. The base portion 12 is designed for coupling to a support structure. The rail member 13 is coupled to the base portion 12 whereby the base portion 12 of each of the support assemblies 11 is designed for supporting the rail member 13 of an associated one of the support assemblies 11 in a spaced relationship above the deck.

Each of a plurality of panel assemblies 14 is slidably coupled to the rail member 13 of each of the support assemblies 11 whereby each of the panel assemblies 14 is positioned between the support assemblies 11. Each of the panel assemblies 14 is slidably positionable along a length of the rail member 13 of each of the support assemblies 11 whereby each of the panel assemblies 14 are designed for covering a portion of the deck from the elements.

Each of the panel assemblies 14 has frame member 15. The frame member 15 provides structural support for the panel assembly. The frame member 15 of each of the panel assemblies 14 has a pair of side portions 16 and a pair of end portions 17.

Each of the panel assemblies 14 has a plurality of roller members 18. Each of the roller members 18 is coupled to one of the side portions 16 of the frame member 15 whereby each of the roller members 18 engages the rail member 13 of one of the support assemblies 11. Each of the roller members 18 is for facilitating sliding of an associated one of the panel assemblies 14 along the support assemblies 11.

Each of the roller members 18 has a wheel 19 and an axle 20. The axle 20 of each of the roller members 18 is couple to one of the side portions 16 of the frame member 15. The wheel 19 is rotatably coupled to a free end 21 of the axle 20 of the associated one of the roller members 18 whereby the wheel 19 is designed for rotationally engaging the rail member 13 of one of the supporting members for facilitating positioning of the panel assembly.

The panel assembly has a plurality of sleeve members 22. Each of the sleeve members 22 is positioned in one of the side portions 16 of the frame member 15 of one of the panel assemblies 14. Each of the sleeve members 22 receives the axle 20 of one of the roller members 18. Each of the sleeve members 22 is for inhibiting the axle 20 of the associated one of the roller members 18 from wearing on the associated one of the side portions 16 of the frame member 15. Each of the sleeve portions of each of the panel assemblies 14 is positioned at an acute angle, approximately 10 degrees, to a bottom face 23 of the associated one of the side portions 16 of the frame member 15 for more evenly distributing a weight of the associated one of the panel assemblies 14 over a length of the axle 20 of each of the roller members 18.

Each of the panel assemblies 14 has a cover member 24. The cover member 24 is coupled to the frame member 15 of the associated one of the panel members whereby the frame member 15 is for supporting the cover member 24. The cover member 24 is designed for directing the elements off of a portion of the deck covered by the panel assembly. The cover member 24 of each of the panel assemblies 14 may be transparent to allow light trough while keeping rain off of the deck or colored to shade the deck as well prevent rain from getting onto the deck. The cover member 24 of each of the panel assemblies 14 has an overhang 25. The overhang 25 extends from one of the side portions 16 of the frame member 15 whereby the overhang 25 of the cover member 24 is designed for being positioned opposite the building for directing rain away from the deck. The cover member 24 of each of the panel assemblies 14 has an extension portion 26. The extension portion 26 extends from one of the edge portions of the frame member 15 of the associated one of the panel assemblies 14. The extension portion 26 of the cover member 24 is for extending over the cover member 24 of an adjacent one of the panel assemblies 14 for preventing rain from entering between the panel assemblies 14 when the panel assemblies 14 are positioned adjacent to each other.

In use, the user secures one of the support assemblies 11 to the building above the deck and the other of the support assemblies 11 in a spaced relation ship from the deck opposite the building. The roller members 18 of the panel assemblies 14 are then slid into the rail member 13*s* of the support assemblies 11 so that the panel assemblies 14 are positioned above the deck. The user can then push the panel assemblies 14 along the support assemblies 11 to position the panel assemblies 14 over a desired portion of the deck.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A deck covering apparatus for covering a portion of a deck of a structure, the deck covering apparatus comprising:

a pair of support assemblies each having a base portion and a rail member, said base portion being adapted for coupling to a support structure, said rail member being coupled to said base portion such that said base portion of each of said support assemblies is adapted for supporting said rail member of an associated one of said support assemblies in a spaced relationship above the deck;

at least one panel assembly slidably coupling to said rail member of each of said support assemblies such that said panel assembly is positioned between said support assemblies, said panel assembly being slidably positionable along a length of said rail member of each of said support assemblies such that said panel assembly is adapted for covering a portion of the deck from the elements;

said panel assembly having frame member, said frame member providing structural support for said panel assembly, said frame member having a pair of side portions and a pair of end portions;

said panel assembly having a cover member, said cover member being coupled to said frame member such that said frame member is for supporting said cover member, said cover member being adapted for directing the elements off of a portion of the deck covered by said panel assembly; and said cover member of said panel assembly having an overhang, said overhang extending from one of said side portions of said frame member such that said overhang of said cover member is adapted for being positioned opposite the building for directing rain away from the deck.

2. The deck covering apparatus as set forth in claim 1, further comprising:

said panel assembly having a plurality of roller members, each of said roller members being coupled to one of said side portions of said frame member such that each of said roller member engages said rail member of one of said support assemblies, each of said roller members being for facilitating sliding of said panel assembly along said support assemblies.

3. The deck covering apparatus as set forth in claim 2, further comprising:

each of said roller members having a wheel and an axle, said axle of each of said roller members being couple to one of said side portions of said frame member, said wheel being rotatably coupled to a free end of said axle of the associated one of said roller members such that said wheel is adapted for rotationally engaging said rail member of one of said supporting members for facilitating positioning of the associated one of said panel assemblies.

4. The deck covering apparatus as set forth in claim 3, further comprising:

said panel assembly having a plurality of sleeve members, each of said sleeve members being positioned in one of said side portions of said frame member, each of said sleeve members receiving said axle of one of said roller members, each of said sleeve members being for inhibiting said axle of the associated one of said roller members from wearing on the associated one of said side portions of said frame member.

5. The deck covering apparatus as set forth in claim 4, wherein each of said sleeve portions of said panel assembly is positioned at an acute angle to a bottom face of the associated one of said side portions of said frame member for more evenly distributing a weight of said panel assembly over a length of said axle of each of said roller members.

6. The deck covering apparatus as set forth in claim 1, further comprising:

a plurality of panel assemblies each being slidably coupling to said rail member of each of said support assemblies such that each of said panel assemblies is positioned between said support assemblies, each of said panel assemblies being slidably positionable along a length of said rail member of each of said support assemblies such that each of said panel assemblies are adapted for covering a portion of the deck from the elements.

7. The deck covering apparatus as set forth in claim 6, further comprising:

each of said panel assemblies having frame member, said frame member providing structural support for said panel assembly, said frame member of each of said panel assemblies having a pair of side portions and a pair of end portions.

8. The deck covering apparatus as set forth in claim 7, further comprising:

each of said panel assemblies having a plurality of roller members, each of said roller members being coupled to one of said side portions of said frame member such that each of said roller members engages said rail member of one of said support assemblies, each of said roller members being for facilitating sliding of an associated one of said panel assemblies along said support assemblies.

9. The deck covering apparatus as set forth in claim 8, further comprising:

each of said roller members having a wheel and an axle, said axle of each of said roller members being couple to one of said side portions of said frame member, said wheel being rotatably coupled to a free end of said axle of the associated one of said roller members such that said wheel is adapted for rotationally engaging said rail member of one of said supporting members for facilitating positioning of said panel assembly.

10. The deck covering apparatus as set forth in claim 9, further comprising:

said panel assembly having a plurality of sleeve members, each of said sleeve members being positioned in one of said side portions of said frame member of one of said panel assemblies, each of said sleeve members receiving said axle of one of said roller members, each of said sleeve members being for inhibiting said axle of the associated one of said roller members from wearing on the associated one of said side portions of said frame member.

11. The deck covering apparatus as set forth in claim 10, wherein each of said sleeve portions of each of said panel assemblies is positioned at an acute angle to a bottom face of the associated one of said side portions of said frame member for more evenly distributing a weight of the associated one of said panel assemblies over a length of said axle of each of said roller members.

12. The deck covering apparatus as set forth in claim 7, further comprising:

each of said panel assemblies having a cover member, said cover member being coupled to said frame member of the associated one of said panel members such that said frame member is for supporting said cover member, said cover member being adapted for directing the elements off of a portion of the deck covered by said panel assembly.

13. The deck covering apparatus as set forth in claim 12, further comprising:

said cover member of each of said panel assemblies having an overhang, said overhang extending from one of said side portions of said frame member such that said overhang of said cover member is adapted for being positioned opposite the building for directing rain away from the deck.

14. The deck covering apparatus as set forth in claim 12, further comprising:

said cover member of each of said panel assemblies having an extension portion, said extension portion extending from one of said edge portions of said frame member of the associated one of said panel assemblies, said extension portion of said cover member being for extending over said cover member of an adjacent one of said panel assemblies for preventing rain from entering between said panel assemblies when said panel assemblies are positioned adjacent to each other.

15. A deck covering apparatus for covering a portion of a deck of a structure, the deck covering apparatus comprising:

a pair of support assemblies each having a base portion and a rail member, said base portion being adapted for coupling to a support structure, said rail member being coupled to said base portion such that said base portion of each of said support assemblies is adapted for supporting said rail member of an associated one of said support assemblies in a spaced relationship above the deck;

a plurality of panel assemblies each being slidably coupling to said rail member of each of said support assemblies such that each of said panel assemblies is positioned between said support assemblies, each of said panel assemblies being slidably positionable along a length of said rail member of each of said support assemblies such that each of said panel assemblies are adapted for covering a portion of the deck from the elements;

each of said panel assemblies having frame member, said frame member providing structural support for said panel assembly, said frame member of each of said panel assemblies having a pair of side portions and a pair of end portions;

each of said panel assemblies having a plurality of roller members, each of said roller members being coupled to one of said side portions of said frame member such that each of said roller members engages said rail member of one of said support assemblies, each of said roller members being for facilitating sliding of an associated one of said panel assemblies along said support assemblies;

each of said roller members having a wheel and an axle, said axle of each of said roller members being couple to one of said side portions of said frame member, said wheel being rotatably coupled to a free end of said axle of the associated one of said roller members such that said wheel is adapted for rotationally engaging said rail member of one of said supporting members for facilitating positioning of said panel assembly;

said panel assembly having a plurality of sleeve members, each of said sleeve members being positioned in one of said side portions of said frame member of one of said panel assemblies, each of said sleeve members receiving said axle of one of said roller members, each of said sleeve members being for inhibiting said axle of the associated one of said roller members from wearing on the associated one of said side portions of said frame member;

each of said sleeve portions of each of said panel assemblies being positioned at an acute angle to a bottom face of the associated one of said side portions of said frame member for more evenly distributing a weight of the associated one of said panel assemblies over a length of said axle of each of said roller members;

each of said panel assemblies having a cover member, said cover member being coupled to said frame member of the associated one of said panel members such that said frame member is for supporting said cover member, said cover member being adapted for directing the elements off of a portion of the deck covered by said panel assembly;

said cover member of each of said panel assemblies having an overhang, said overhang extending from one of said side portions of said frame member such that said overhang of said cover member is adapted for being positioned opposite the building for directing rain away from the deck; and said cover member of each of said panel assemblies having an extension portion, said extension portion extending from one of said edge portions of said frame member of the associated one of said panel assemblies, said extension portion of said cover member being for extending over said cover member of an adjacent one of said panel assemblies for preventing rain from entering between said panel assemblies when said panel assemblies are positioned adjacent to each other.

16. A deck covering apparatus for covering a portion of a deck of a structure, the deck covering apparatus comprising:

a pair of support assemblies each having a base portion and a rail member, said base portion being adapted for coupling to a support structure, said rail member being coupled to said base portion such that said base portion of each of said support assemblies is adapted for supporting said rail member of an associated one of said support assemblies in a spaced relationship above the deck;

a plurality of panel assemblies each being slidably coupling to said rail member of each of said support assemblies such that each of said panel assemblies is positioned between said support assemblies, each of said panel assemblies being slidably positionable along a length of said rail member of each of said support assemblies such that each of said panel assemblies are adapted for covering a portion of the deck from the elements;

each of said panel assemblies having frame member, said frame member providing structural support for said panel assembly, said frame member of each of said panel assemblies having a pair of side portions and a pair of end portions;

each of said panel assemblies having a cover member, said cover member being coupled to said frame member of the associated one of said panel members such that said frame member is for supporting said cover member, said cover member being adapted for directing the elements off of a portion of the deck covered by said panel assembly; and said cover member of each of said panel assemblies having an extension portion, said extension portion extending from one of said edge portions of said frame member of the associated one of said panel assemblies, said extension portion of said cover member being for extending over said cover member of an adjacent one of said panel assemblies for preventing rain from entering between said panel assemblies when said panel assemblies are positioned adjacent to each other.

* * * * *